US010403948B2

(12) United States Patent
Murano et al.

(10) Patent No.: US 10,403,948 B2
(45) Date of Patent: Sep. 3, 2019

(54) ADJUSTABLE PHASE SHIFTER INCLUDING A SIGNAL CONDUCTOR, A MOVABLE DIELECTRIC PLATE AND A TRANSFORMER UNIT, WHERE THE TRANSFORMER UNIT DEFINES OVERLAPPED AND NON-OVERLAPPED PORTIONS WITH RESPECT TO THE SIGNAL CONDUCTOR

(71) Applicant: HITACHI METALS, LTD., Minato-ku, Tokyo (JP)

(72) Inventors: Shinsuke Murano, Kasama (JP); Ryoji Matsubara, Toshima-ku (JP); Kei Kawano, Tokai-mura (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/638,793

(22) Filed: Jun. 30, 2017

(65) Prior Publication Data

US 2018/0013186 A1 Jan. 11, 2018

(30) Foreign Application Priority Data

Jul. 8, 2016 (JP) ..... 2016-135702

(51) Int. Cl.
*H01P 1/18* (2006.01)
*H01Q 3/26* (2006.01)

(52) U.S. Cl.
CPC ..... *H01P 1/184* (2013.01); *H01Q 3/2694* (2013.01)

(58) Field of Classification Search
CPC ..... H01P 1/184; H01P 1/18
(Continued)

(56) References Cited

U.S. PATENT DOCUMENTS 3,440,573 A * 4/1969 Butler ..... H01P 1/183 333/156
5,905,462 A * 5/1999 Hampel et al. ..... H01Q 3/26 333/159

(Continued)

FOREIGN PATENT DOCUMENTS

JP 11-205002 A 7/1999

*Primary Examiner* — Benny T Lee
(74) *Attorney, Agent, or Firm* — Foley & Lardner LLP

(57) ABSTRACT

A phase shifter includes a signal conductor constituting a transmission line for a signal transmitted through an antenna element, a dielectric plate including a dielectric material disposed to face to the signal conductor, and a mobile mechanism for moving the dielectric plate. A facing area between the signal conductor and the dielectric plate is changed by a movement of the dielectric plate, to change a phase of the signal transmitted through the signal conductor. The dielectric plate includes a transformer unit for impedance matching between an overlapped portion in which the signal conductor faces to the dielectric plate and a non-overlapped portion in which the signal conductor does not face to the dielectric plate. The signal conductor includes an input-side signal conductor which extends from the non-overlapped portion to the overlapped portion via the transformer unit, and an output-side signal conductor which is electrically connected to an end of the input-side signal conductor on a side of the overlapped portion and extends from the overlapped portion to the non-overlapped portion without any intervention of the transformer unit.

4 Claims, 4 Drawing Sheets

(58) Field of Classification Search
USPC ..... 333/161
See application file for complete search history.

(56) References Cited

U.S. PATENT DOCUMENTS

| | | | | |
|---|---|---|---|---|
| 6,075,424 | A * | 6/2000 | Hampel et al. | H01P 1/184 333/161 |
| 2004/0246175 | A1* | 12/2004 | Thomas | H01P 1/184 342/372 |
| 2015/0207227 | A1* | 7/2015 | Iso et al. | H01Q 3/32 343/853 |

* cited by examiner

ADJUSTABLE PHASE SHIFTER INCLUDING A SIGNAL CONDUCTOR, A MOVABLE DIELECTRIC PLATE AND A TRANSFORMER UNIT, WHERE THE TRANSFORMER UNIT DEFINES OVERLAPPED AND NON-OVERLAPPED PORTIONS WITH RESPECT TO THE SIGNAL CONDUCTOR

The present application is based on Japanese patent application No. 2016-135702 filed on Jul. 8, 2016, the entire contents of which are incorporated herein by reference.

BACKGROUND OF THE INVENTION

1. Field of the Invention

The present invention relates to a phase shifter and an antenna device using the same.

2. Description of the Related Art

Conventionally, a phase shifter which can regulate a phase of signals transmitted or received via an antenna element has been used for, e.g., a base station antenna for cellular phones (e.g., see JP-A H11-205002).

In the phase shifter described in JP-A H11-205002, an inner conductor of a triplate line is formed to have a one-side opened rectangular shape and a dielectric plate is inserted to be movable between a grounding conductor and the inner conductor of the triplate line. An overlap area of the inner conductor and the dielectric plate changes by moving the dielectric plate in this phase shifter. Further, an effective dielectric constant in the triplate line changes in accordance with the change in this overlap area, and an electrical line length changes in accordance with this change in the effective dielectric constant, so that the phase of the signals propagating through the inner conductor changes. In the conventional phase shifters, the input impedance and the output impedance are generally set to be the same (e.g., 50Ω).

SUMMARY OF THE INVENTION

In antenna devices, the output of the phase shifter is often connected to a 2-divider distribution circuit. For example, one of the outputs of the 2-divider distribution circuit is connected to a radiating element, and the other of the outputs of the 2-divider distribution circuit is connected to a phase shifter at the next stage.

It has been known that when the 2-divider distribution circuit is designed in such a manner that an application frequency band would be as broad as possible, the input will have low impedance while the output will have high impedance. As described above, because the output impedance of the conventional phase shifter was set to be the same as the impedance of the transmission line, it has been necessary to further (separately) provide a transformer such as 214 transformer between the phase shifter and the 2-divider distribution circuit in order to connect the 2-dividier distribution circuit having a broadband and a low input impedance to the next stage. A further improvement has been desired since the addition of the transformer may lead to an increase in the size upsizing of the phase shifter.

Accordingly, it is an object of the present invention to provide a phase shifter with a small size and low output impedance. It is a further object of the present invention to provide an antenna device using the same.

According to an embodiment of the present invention, a phase shifter comprises:

a signal conductor constituting a transmission line for a signal transmitted through an antenna element;

a dielectric plate comprising a dielectric material disposed to face to the signal conductor; and a mobile mechanism for moving the dielectric plate, wherein a facing area between the signal conductor and the dielectric plate is changed by a movement of the dielectric plate, to change a phase of the signal transmitted through the signal conductor, wherein the dielectric plate includes a transformer unit for impedance matching between an overlapped portion in which the signal conductor faces to the dielectric plate and a non-overlapped portion in which the signal conductor does not face to the dielectric plate, wherein the signal conductor includes an input-side signal conductor which extends from the non-overlapped portion to the overlapped portion via the transformer unit, and an output-side signal conductor which is electrically connected to an end of the input-side signal conductor on a side of the overlapped portion and extends from the overlapped portion to the non-overlapped portion without any intervention of the transformer unit.

According to another embodiment of the present invention, an antenna device comprises the aforementioned phase shifter.

(Points of the Invention)

According to the present invention, it is possible to provide a phase shifter with a small size and low output impedance and an antenna device using the same.

BRIEF DESCRIPTION OF DRAWINGS

The embodiments according to the present invention will be explained below in conjunction with appended drawings, wherein.

DETAILED DESCRIPTION OF THE EMBODIMENTS

Embodiments

The embodiments of the present invention will be described below in conjunction with the appended drawings.

Figure 1:
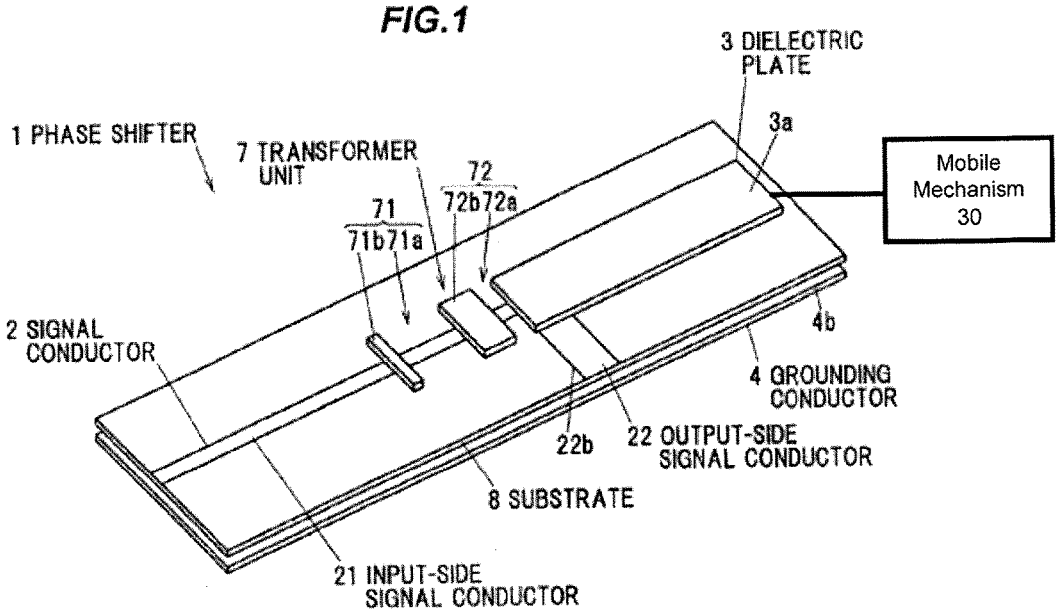
FIG. 1 is a perspective view showing a phase shifter in one embodiment according to the present invention in which one of the grounding conductors is omitted.

FIG. 1 is a perspective view showing a phase shifter 1 in one embodiment according to the present invention in which one of grounding conductors 4 is omitted.

Figure 2A:
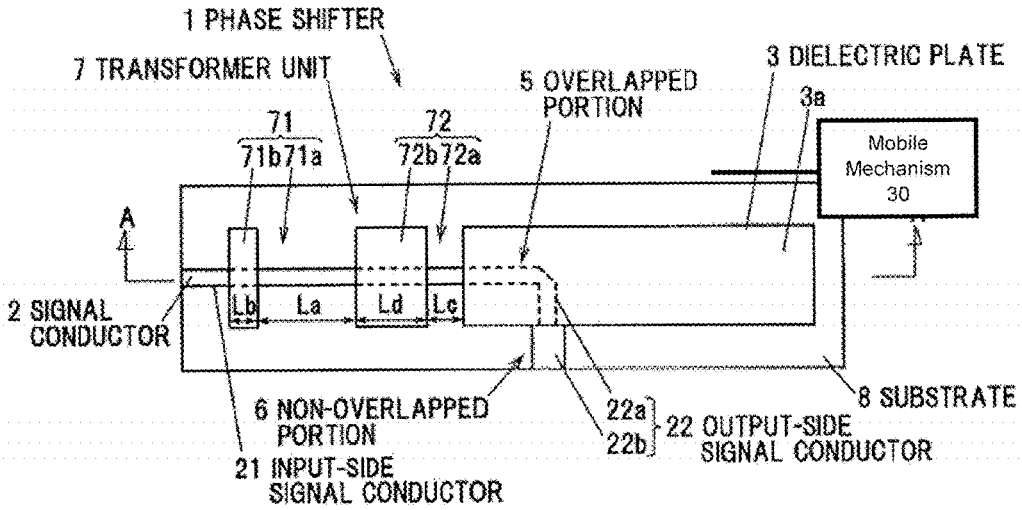
FIG. 2A is a plan view of the phase shifter in FIG. 1 in which one of the grounding conductors is omitted and FIG. 2B is a cross sectional view along A-A line of FIG. 2A.
Figure 2B:
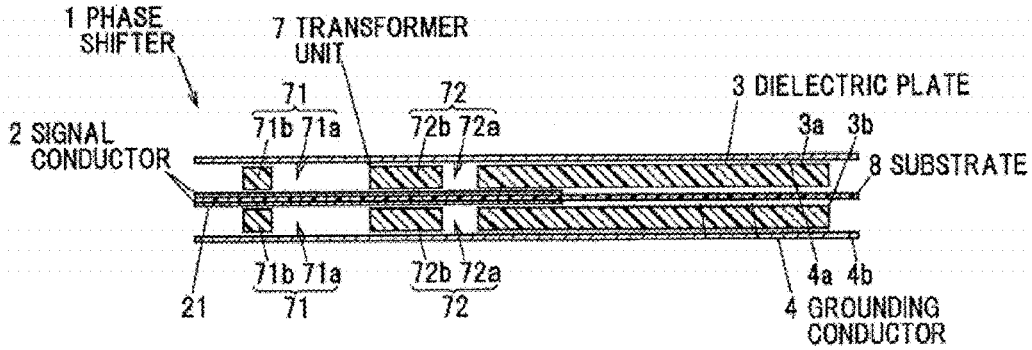

FIG. 2A is a plan view of the phase shifter 1 in FIG. 1 in which one of the grounding conductors 4 is omitted and FIG. 2B is a cross sectional view along A-A line of FIG. 2A thereof;

As shown in FIGS. 1, 2A and 2B, the phase shifter 1 comprises a signal conductor 2 constituting a transmission line for signals transmitted through an antenna element (not shown), a dielectric plate 3 composed of a dielectric material disposed to face to the signal conductor 2, and a mobile mechanism 30 (FIGS. 1 and 2A) for moving the dielectric plate 3.

In the present embodiment, the signal conductor 2 comprises wiring patterns formed on a front surface and a back surface of a substrate 8 (FIGS. 1, 2A and 2B) comprising glass epoxy or the like. The wiring patterns having the same shape when viewed from one side of the thickness direction (i.e. the wiring patterns are symmetrical with respect to the center of the thickness direction of the substrate 8) are formed on the front surface and the back surface of the substrate 8 as the signal conductor 2. The wiring patterns formed on the front surface and the back surface of the substrate 8 may be electrically connected to each other by a through-hole penetrating through the substrate 8.

Note that, in the present embodiment, the wiring patterns formed on the front surface and the back surface of the substrate 8 are used as the signal conductor 2, however, a plate-like member comprising a good electrical conductor may be used as the signal conductor. Also, the signal conductor 2 may be a wiring pattern formed on one surface of the substrate 8 when a film-like material is used as the substrate 8.

The signal conductor 2 comprises an input-side signal conductor 21 formed in a linear shape and an output-side signal conductor 22 (FIGS. 1 and 2A) formed in a linear shape. In the present embodiment, the output-side signal conductor 22 is disposed at right angles to the input-side signal conductor 21, so that the signal conductor 2 is formed totally in an L-shape in a plan view. The input-side signal conductor 21 and the output-side signal conductor 22 will be described in more detail below.

The phase shifter 1 comprises a grounding conductor 4 (FIGS. 1 and 2B) disposed on one side of the dielectric plate 3 (e.g., one side of the first dielectric plate 3*a*) while the signal conductor 2 is disposed on another side of the dielectric plate 3 (e.g., the other side of the first dielectric plate 3*a*), namely the grounding conductor 4 is disposed on the side opposite to the side where the signal conductor 2 is disposed. The grounding conductor 4 comprises a plate-like member comprising the good electrical conductor. In the present embodiment, the phase shifter 1 has a triplate structure in which two pieces of the grounding conductor 4 sandwiches the signal conductor 2 from upper and lower sides. The grounding conductor 4 provided above (the upper part of FIG. 2B) the signal conductor 2 is hereinafter referred to as a first grounding conductor 4*a*, and the grounding conductor 4 provided beneath (the lower part of FIG. 2B) the signal conductor 2 is hereinafter referred to as a second grounding conductor 4*b*. Note that FIGS. 1 and 2A are the drawings in which the first grounding conductor 4*a* is omitted.

The dielectric plate 3 comprises a rectangular plate-like member in a plan view. In the present embodiment, the dielectric plate 3 comprises a first dielectric plate 3*a* and a second dielectric plate 3*b* (FIG. 2B) disposed to sandwich the signal conductor 2 from the upper and lower sides. The first dielectric plate 3*a* is placed between the signal conductor 2 and the first grounding conductor 4*a*, and the second dielectric plate 3*b* is placed between the signal conductor 2 and the second grounding conductor 4*b*. Both the dielectric plates 3*a*, 3*b* are spaced apart from the signal conductor 2 and the grounding conductor 4 so as not to be affected by an electric field generated in the vicinity of the signal conductor 2 and the grounding conductor 4. In other words, the first dielectric plate 3*a* is spaced apart from the signal conductor 2 and the first grounding conductor 4*a*, and the second dielectric plate 3*b* is spaced apart from the signal conductor 2 and the second grounding conductor 4*b*.

The first dielectric plate 3*a* and the second dielectric plate 3*b* are connected to each other by a connecting member (not shown). Both the dielectric plates 3*a*, 3*b* are configured to be movable along a longitudinal direction of the input-side signal conductor 21 (in a lateral direction in FIGS. 2A and 2B) by the mobile mechanism 30 (FIGS. 1 and 2A) such as DC motor.

Hereinafter, in the phase shifter 1, a part where the dielectric plate 3 overlaps with the signal conductor 2 is referred to as an overlapped portion 5 (FIG. 2A), and a part where the dielectric plate 3 does not overlap with the signal conductor 2 is referred to as a non-overlapped portion 6 (FIG. 2A). The non-overlapped portion 6 is a part where the signal conductor 2 and the grounding conductor 4 are facing to each other via an air layer.

The phase shifter 1 is configured in such a matter manner that the dielectric plate 3 is moved by the mobile mechanism 30 (FIGS. 1 and 2A) to change a facing area between the signal conductor 2 and the dielectric plate 3 (the area of the overlapped portion 5), to change the phase of the signal transmitted through the signal conductor 2. In the phase shifter 1, the phase of the signal is delayed in accordance with the increase in the area of the overlapped portion 5, and the phase of the signal is advanced in accordance with the decrease in the area of the overlapped portion 5. Thus, in the case of FIGS. 2A and 2B, by moving the dielectric plate 3 from a certain reference position towards the left side in FIGS. 2A and 2B (a signal input-side of the input-side signal conductor 21), the phase of the signal can be delayed with respect to the phase at the reference position. To the contrary, by moving the dielectric plate 3 from the reference position towards the right side in FIGS. 2A and 2B (a side of the output-side signal conductor 22), the phase of the signal can be advanced with respect to the phase at the reference position. The moving range of the dielectric plate 3 is preset, and the phase shifter 1 is configured to change the area of the overlapped portion 5 by moving the dielectric plate 3 within the above moving range, to change the phase of the signal.

(Explanation of the Transformer Unit 7)

In the phase shifter 1 according to the present embodiment, the dielectric plate 3 includes a transformer unit 7 for matching the impedance between the overlapped portion 5 and the non-overlapped portion 6.

Although the details thereof will be described below, the output-side signal conductor 22 is arranged so as not to pass through the transformer unit 7 (i.e. not to overlap with the transformer unit 7) in the present embodiment. In the present embodiment, the transformer unit 7 is provided at an input-side end of the input-side signal conductor 21 in a moving direction (the lateral direction in the drawings) of the dielectric plate 3 in a boundary between the overlapped portion 5 and the non-overlapped portion 6. Because the dielectric plate 3 is moved along the longitudinal direction of the input-side signal conductor 21, the transformer unit 7 will be always in the position overlapping with the input-side signal conductor 21 (between the overlapped portion 5 and the non-overlapped portion 6).

Although the transformer unit 7 can be formed by processing a part of the dielectric plate 3 (to be described in more detail below), in, the present embodiment, the transformer unit 7 is not treated as a part of the dielectric plate 3 but as a member separate from the dielectric plate 3. In other words, the overlapped portion 5 does not include the part where the signal conductor 2 overlaps with the transformer unit 7.

In the phase shifter 1, the transformer unit 7 has a two-stage structure. The transformer unit 7 comprises a first transformer unit 71 formed on the side of the non-overlapped portion 6, and a second transformer unit 72 formed on the side of the overlapped portion 5.

The first transformer unit 71 comprises a first high impedance part 71*a* provided on the side of the overlapped portion 5 (i.e. on the side of the second transformer unit 72), and a first low impedance part 71*b* provided on the side of the non-overlapped portion 6 of the first high impedance part 71*a* and having a characteristic impedance lower than that of the first high impedance part 71*a*. The effective dielectric constant between the signal conductor 2 and the grounding conductor 4 in the first high impedance part 71*a* is lower than the effective dielectric constant between the signal conductor 2 and the grounding conductor 4 in the first low impedance part 71*b*.

The second transformer unit 72 comprises a second high impedance part 72*a* provided on the side of the overlapped portion 5, and a second low impedance part 72*b* provided on the side of the non-overlapped portion 6 (i.e. on the side of the first transformer unit 71) of the second high impedance part 72*a* and having a characteristic impedance lower than that of the second high impedance part 72*a*. The effective dielectric constant between the signal conductor 2 and the grounding conductor 4 in the second high impedance part 72*a* is lower than the effective dielectric constant between the signal conductor 2 and the grounding conductor 4 in the second low impedance part 72*b*.

In the phase shifter 1, the first transformer unit 71 is configured to adjust the lengths La, Lb (FIG. 2A) of the first impedance parts 71*a*, 71*b*, to match a characteristic impedance of the non-overlapped portion 6 and a characteristic impedance of an intermediate portion between the overlapped portion 5 and the non-overlapped portion 6 (hereinafter referred to as "intermediate characteristic impedance"). The second transformer unit 72 is configured to adjust the lengths Lc, Ld (FIG. 2A) of the second impedance parts 72*a*, 72*b*, to match the intermediate characteristic impedance and a characteristic impedance of the overlapped portion 5. Although the transformer unit 7 is designed to have the two stage structure here, but the present invention is not limited thereto. The transformer unit 7 may be designed to have a one stage structure.

In the present embodiment, each of the high impedance parts 71*a*, 72*a* comprises an air layer, while each of the low impedance parts 71*b*, 72*b* comprises a dielectric material layer which has the same thickness as that of the dielectric plate 3 and comprises the same material as that of the dielectric plate 3.

Figure 3:
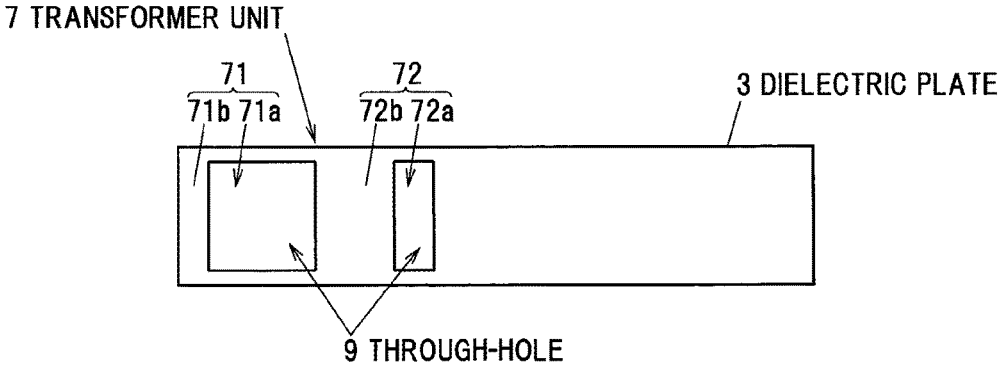
FIG. 3 is a plan view indicating an example of a dielectric plate and a transformer unit to be used for the phase shifter in FIG. 1.

FIG. 3 is a plan view indicating an example of the dielectric plate 3 and the transformer unit 7 to be used for the phase shifter in FIG. 1.

As shown in FIG. 3, for example, two through-holes 9 formed at the dielectric plate 3 may be provided as the high impedance part 71*a* of the first transformer unit 71 and the high impedance part 72*a* of the second transformer unit 72, and a portion of the dielectric plate 3 disposed between the through-hole 9 and an end of the dielectric plate 3 and a portion of the dielectric plate 3 disposed between both through-holes 9 may be provided as the low impedance part 71*b* of the first transformer unit 71 and the low impedance part 72*b* of the second transformer unit 72, thereby constituting the transformer unit 7. Thus, the transformer unit 7 can be easily achieved by merely forming the through-holes 9 at the dielectric plate 3 based on the configuration in which each of the high impedance parts 71*a*, 72*a* comprises the air layer, while each of the low impedance parts 71*b*, 72*b* comprises the dielectric material layer, which has the same thickness as that of the dielectric plate 3 and comprises the same material as that of the dielectric plate 3. Although the through-hole 9 is formed in a rectangular-shape in FIG. 3, the shape of the through-hole 9 is not limited thereto. Also, the through-hole 9 may be a notch which is opened at a side surface (the upper part or the lower part in FIG. 3) of the dielectric plate 3.

(Detailed Explanation of the Signal Conductor 2)

In the phase shifter 1 in the present embodiment, the signal conductor 2 comprises the input-side signal conductor 21 which extends from the non-overlapped portion 6 to the overlapped portion 5 via the transformer unit 7, and the output-side signal conductor 22 which is electrically connected to an end of the input-side signal conductor 21 on the side of the overlapped portion 5 and extends from the overlapped portion 5 to the non-overlapped portion 6 without any intervention of the transformer unit 7.

As described above, in the present embodiment, each of the input-side signal conductor 21 and the output-side signal conductor 22 is formed in a linear shape and the input-side signal conductor 21 and the output-side signal conductor 22 are arranged at right angles (to have an L-shape). An outside corner of a connecting portion between the input-side signal conductor 21 and the output-side signal conductor 22 has a chamfered shape. The transformer unit 7 is provided at the input-side end of the input-side signal conductor 21 on the dielectric plate 3, while the transformer unit 7 is not formed at the end through which the output-side signal conductor 22 passes in the dielectric plate 3.

The output-side signal conductor 22 comprises a first output-side signal conductor 22*a* (FIG. 2A) disposed at the overlapped portion 5 and a second output-side signal conductor 22*b* (FIGS. 1 and 2A) disposed at the non-overlapped portion 6 integrally as one piece. In the present embodiment, a conductor cross section of the second output-side signal conductor 22*b* is greater than a conductor cross section of the first output-side signal conductor 22*a*, because when the conductor cross sections of the first and second output-side signal conductors 22*a*, 22*b* are identical to each other, a difference in the characteristic impedance occurs due to the presence or absence of the dielectric plate 3 and the trouble such as reflection occurs at the boundary between the first output-side signal conductor 22*a* and the second output-side signal conductor 22*b*.

The conductor cross section of the second output-side signal conductor 22*b* is adjusted appropriately in such a manner that the characteristic impedance of the first output-side signal conductor 22*a* matches the characteristic impedance of the second output-side signal conductor 22*b*. In other words, in the present embodiment, the output impedance of the phase shifter 1 is identical to the characteristic impedance at the overlapped portion 5.

That is, by extending the output-side signal conductor 22 from a side of the overlapped portion 5 to a side of the non-overlapped portion 6 without any intervention of the transformer unit 7, it is possible to achieve the output with the low impedance equivalent to the characteristic impedance at the overlapped portion 5. As a result, even though a broadband 2-divider distribution circuit with low input impedance is used, it is not necessary to further (separately) provide a transformer between the 2-divider distribution circuit and the phase shifter 1. In other words, according to the phase shifter 1, it is possible to design a configuration that there is no difference (or substantially no difference) between the output impedance of the phase shifter 1 and the input impedance of the 2-divider distribution circuit at the next stage, so that it is no longer necessary to insert a transformer such as λ/4 transformer between the phase shifter 1 and the 2-divider distribution circuit.

Note that the characteristic impedance of the second output-side signal conductor 22*b* does not need to be the completely the same as that of the first output-side signal conductor 22*a*, and a certain margin is tolerated. Specifically, the difference in the characteristic impedance between the output-side signal conductors 22*a*, 22*b* should be not greater than 10% of the characteristic impedance of the first output-side signal conductor 22*a*.

In the present embodiment, since the signal conductor 2 comprises the wiring patterns with a constant thickness, the conductor cross section of the signal conductor 2 is adjusted by a width (conductor width) of the signal conductor 2. That is, in the present embodiment, the width of the second output-side signal conductor 22*b* is greater than the width of the first output-side signal conductor 22*a*. The conductor cross section (width) of the input-side signal conductor 21 and the conductor cross section (width) of the first output-side signal conductor 22*a* are substantially the same so as to suppress the reflections on the boundary between the input-side signal conductor 21 and the first output-side signal conductor 22*a*. Therefore, the conductor cross section (width) of the second output-side signal conductor 22*b* is greater than the conductor cross section (width) of the input-side signal conductor 21. Note that the conductor cross section (width) of the input-side signal conductor 21 is set to be constant.

Problems due to the impedance mismatch will occur if the boundary between the first output-side signal conductor 22*a* and the second output-side signal conductor 22*b* where the conductor cross section changes deviates from an edge portion (the boundary between the overlapped portion 5 and the non-overlapped portion 6) of the dielectric plate 3. Therefore, it is necessary to configure the dielectric plate 3 to move along the boundary between the first output-side signal conductor 22*a* and the second output-side signal conductor 22*b*.

In the present embodiment, an extending-side end of the output-side signal conductor 22 on the dielectric plate 3 to be disposed is formed to be in parallel to the moving direction (the longitudinal direction of the input-side signal conductor 21) of the dielectric plate 3. According to this configuration, the boundary between the first output-side signal conductor 22*a* and the second output-side signal conductor 22*b* always matches with the boundary between the overlapped portion 5 and the non-overlapped portion 6 regardless of the movement of the dielectric plate 3. Thus, in the present embodiment, the output-side signal conductor 22 extends from the end of the dielectric plate 3 formed to be placed in parallel to the moving direction of the dielectric plate 3, and the conductor cross section (width) changes at the boundary between the overlapped portion 5 and the non-overlapped portion 6, i.e. the conductor cross section (width) on the side of the non-overlapped portion 6 is greater than that on the side of the overlapped portion 5.

(Explanation of an Antenna Device)

Figure 4:
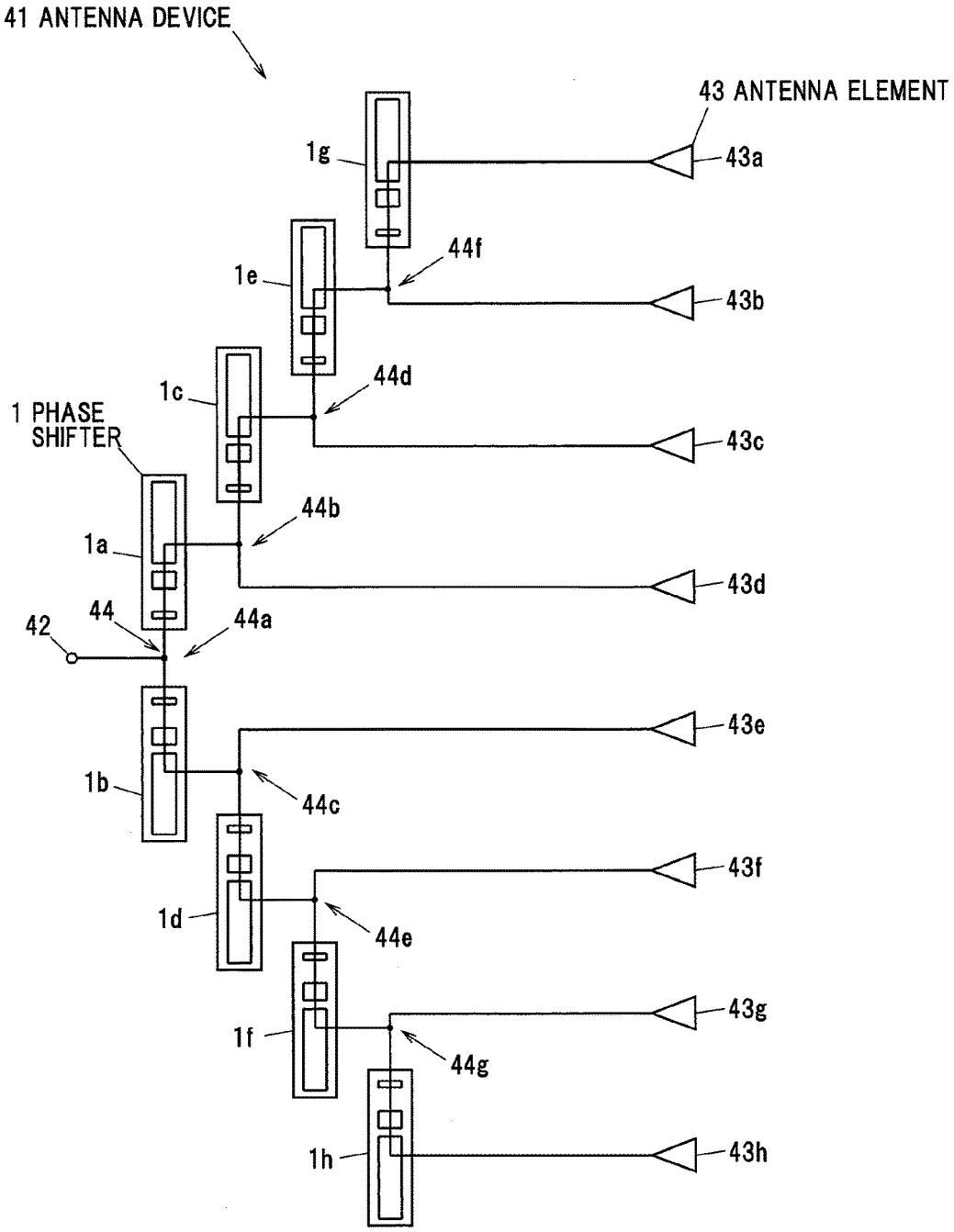
FIG. 4 is a schematic diagram of an antenna device using the phase shifter of FIG. 1.

FIG. 4 is a schematic diagram of an antenna device 41 using the phase shifter 1 of FIG. 1.

As shown in FIG. 4, the antenna device 41 comprises an input terminal 42 to which a high frequency signal is input, a plurality (eight in this embodiment) of phase shifters 1 (1*a*, 1*b*, 1*c*, 1*d*, 1*e*, 1*f*, 1*g*, and 1*h*), a plurality (seven in this embodiment) of 2-divider distribution circuits 44 (44*a*, 44*b*, 44*c*, 44*d*, 44*e*, 44*f*, and 44 *g*), and a plurality (eight in this embodiment) of antenna elements 43 (43*a*, 43*b*, 43*c*, 43*d*, 43*e*, 43*f*, 44*g*, and 43*h*). For example, the antenna device 41 may be used as a base station antenna for cellular phones.

The antenna elements 43 are arranged to be aligned in the vertical direction. Herein, the antenna elements 43*a*-43*h* are sequentially arranged from the top to the bottom in the vertical direction.

The 2-divider distribution circuit 44 comprises a first distribution circuit 44*a* which divides the signal input from the input terminal 42 into two, second distribution circuits 44*b*, 44*c* each of which further divides the two divided signals divided by the first distribution circuit 44*a*, third distribution circuits 44*d*, 44*e* each of which further divides one of the two divided signals divided by the second distribution circuits 44*b*, 44*c*, and fourth distribution circuits 44*f*, 44*g* each of which further divides one of the two divided signals divided by the third distribution circuits 44*d*, 44*e*.

The phase shifter 1*a* is placed between one output of the first distribution circuit 44*a* and an input of the second distribution circuit 44*b*, and the phase shifter 1*b* is placed between the other output of the first distribution circuit 44*a* and an input of the second distribution circuit 44*c*. Also, the phase shifter 1*c* is placed between one output of the second distribution circuit 44*b* and an input of the third distribution circuit 44*d*, and the other output of the second distribution circuit 44*b* is connected to the antenna element 43*d*. Similarly, the phase shifter 1*d* is placed between one output of the second distribution circuit 44*c* and an input of the third distribution circuit 44*e*, and the other output of the second distribution circuit 44*c* is connected to the antenna element 43*e*.

The phase shifter 1*e* is placed between one output of the third distribution circuit 44*d* and an input of the fourth distribution circuit 44*f*, and the other output of the third distribution circuit 44*d* is connected to the antenna element 43*c*. Similarly, the phase shifter if is placed between one output of the third distribution circuit 44*e* and an input of the fourth distribution circuit 44*g*, and the other output of the third distribution circuit 44*d* is connected to the antenna element 43*c*.

One output of the fourth distribution circuit 44*f* is connected to the antenna element 43*a* via the phase shifter 1*g*, and the other output of the fourth distribution circuit 44*f* is connected to the antenna element 43*b*. Similarly, one output of the fourth distribution circuit 44*g* is connected to the antenna element 43*h* via the phase shifter 1*h*, and the other output of the fourth distribution circuit 44*g* is connected to the antenna element 43*g*.

Herein, the antenna device 41 is configured in such a manner that when the phase shifters 1*a*, 1*c*, 1*e*, 1*g* advance the phase with a predetermined phase shifting amount, the phase shifters 1*b*, 1*d*, 1*f*, 1*h* delay the phase with the same shifting amount. Herein, the phase shifters 1*a*, 1*c*, 1*e*, 1*g* and the phase shifters 1*b*, 1*d*, 1*f*, 1*h* are arranged oppositely with respect to the moving direction of the dielectric plates 3 and the dielectric plates 3 of all the phase shifters 1*a*-1*h* are connected to move together. According to this configuration, it is possible to provide a differential phase shifter in which the phase is advanced in one of the phase shifters 1*a*, 1*c*, 1*e*, 1*g* and the phase shifters 1*b*, 1*d*, 1*f*, 1*h*, and the phase is delayed in the other of the phase shifters 1*a*, 1*c*, 1*e*, 1*g* and the phase shifters 1*b*, 1*d*, 1*f*, 1*h*.

In the antenna device 41, it is possible to adjust the directionality (electrical tilt angle) of an electric wave emitted from the antenna elements 43*a*-43*h* by changing the signal phase by the phase shifters 1*a*-1*h*. Here, the case using eight antenna elements 43 (43*a*-43*h*) and eight phase shifters 1 (1*a*-1*h*) is described, but the number of antenna elements 43 and the phase shifters 1 is merely one example and the present invention is not limited to the example shown in FIG. 4.

Function and Effect of the Embodiments

As explained above, in the phase shifter 1 in the present embodiment, the dielectric plate 3 comprises the transformer unit 7 for matching the impedance of the overlapped portion 5 and the impedance of the non-overlapped portion 6, and the signal conductor 2 comprises the input-side signal conductor 21 which extends from the non-overlapped portion 6 to the overlapped portion 5 via the transformer unit 7, and the output-side signal conductor 22 which is electrically connected to an end of the input-side signal conductor 21 on the side of the overlapped portion 5 and extends from the overlapped portion 5 to the non-overlapped portion 6 without any intervention of the transformer unit 7.

By providing the output-side signal conductor 22 extending from the overlapped portion 5 to the non-overlapped portion 6 without passing through the transformer unit 7, it is possible to lower the output impedance of the phase shifter 1 to be substantially equivalent to the characteristic impedance at the overlapped portion 5. Accordingly, even though the broadband-adapted 2-divider distribution circuit with low input impedance is connected to the next stage, it is possible to decrease the difference (or substantially zero difference) between the output impedance of the phase shifter 1 and the input impedance of the 2-divider distribution circuit 44. As a result, it is no longer necessary to insert a transformer such as $\lambda/4$ transformer between the phase shifter 1 and the 2-divider distribution circuit, which contributes to a decrease in the size of the phase shifter 1.

Further, in the present embodiment, because each of the input-side signal conductor 21 and the output-side signal conductor 22 is formed in a linear shape and the input-side signal conductor 21 and the output-side signal conductor 22 are placed at right angles to each other, it is possible to decease the width of the phase shifter 1 and the width of the dielectric plate 3 as compared with the case where the signal conductor 22 is formed to have a one-side opened rectangular shape, which contributes to additional downsizing of the phase shifter 1.

Still further, in the present embodiment, because the mobile mechanism moves the dielectric plate 3 along the longitudinal direction of the input-side signal conductor 21 and the transformer unit 7 is provided at the input-side end of the input-side signal conductor 21 among the both ends in the moving direction of the dielectric plate 3, the input-side signal conductor 21 will be always introduced from the non-overlapped portion 6 towards the overlapped portion 5 via the transformer unit 7 regardless of the movement of the dielectric plate 3. Accordingly, it is possible to suppress the impedance mismatch at the boundary between the non-overlapped portion 6 and the overlapped portion 5 in the input-side signal conductor 21.

Furthermore, in the present embodiment, the output-side signal conductor 22 comprises the first output-side signal conductor 22*a* disposed at the overlapped portion 5 and the second output-side signal conductor 22*b* disposed at the non-overlapped portion 6 integrally as one piece, and the conductor cross section of the second output-side signal conductor 22*b* is greater than the conductor cross section of the first output-side signal conductor 22*a*. According to this configuration, the characteristic impedance in the second output-side signal conductor 22*b* (the non-overlapped portion 6) can be approximated to the characteristic impedance in the first output-side signal conductor 22*a* (the overlapped portion 5). As a result, it is possible to suppress the impedance mismatch at the boundary between the non-overlapped portion 6 and the overlapped portion 5 in the output-side signal conductor 22, and to decrease the output impedance of the phase shifter 1 to be substantially equivalent to the characteristic impedance of the overlapped portion 5.

Summary of the Embodiment

Next, the technical concept that is ascertained from the embodiments described above will be described with the aid of the reference characters and the like in the embodiment. It should be noted, however, that each of the reference characters in the following description should not be construed as limiting the constituent elements in the claims to the members and the like specifically shown in the embodiments.

[1] A phase shifter (1) comprises:

a signal conductor (2) constituting a transmission line for a signal transmitted through an antenna element (43);

a dielectric plate (3) comprising a dielectric material disposed to face to the signal conductor (2); and a mobile mechanism for moving the dielectric plate (3), in which a facing area between the signal conductor (2) and the dielectric plate (3) is changed by a movement of the dielectric plate (3), to change a phase of the signal transmitted through the signal conductor (2), in which the phase shifter (1) includes a transformer unit (7) for impedance matching between an overlapped portion (5) in which the signal conductor (2) faces to the dielectric plate (3) and a non-overlapped portion (6) in which the signal conductor (2) does not face to the dielectric plate (3), in which the signal conductor (2) includes an input-side signal conductor (21) which extends from the non-overlapped portion (6) to the overlapped portion (5) via the transformer unit (7), and an output-side signal conductor (22) which is electrically connected to an end of the input-side signal conductor (21) on a side of the overlapped portion (5) and extends from the overlapped portion (5) to the non-overlapped portion (6) without any intervention of the transformer unit (7).

[2] The phase shifter (1) according to [1], in which the input-side signal conductor (21) is formed in a linear shape and the output-side signal conductor (22) formed in a linear shape, in which the output-side signal conductor (22) is disposed at right angles to the input-side signal conductor (21).

[3] The phase shifter (1) according to [2], in which the mobile mechanism moves the dielectric plate (3) along a longitudinal direction of the input-side signal conductor (21), and the transformer unit (7) is provided at an input-side end of the input-side signal conductor (21) among both ends in a moving direction of the dielectric plate (3).

[4] The phase shifter (1) according to [3], in which the output-side signal conductor (22) comprises a first output-side signal conductor (22*a*) disposed at the overlapped portion (5) and a second output-side signal conductor (22*b*) disposed at the non-overlapped portion (6) integrally as one piece, in which a conductor cross section of the second output-side signal conductor (22*b*) is greater than a conductor cross section of the first output-side signal conductor (22*a*).

[5] The phase shifter (1) according to any one of [1] to [4], in which the transformer unit (7) comprises an air layer (71*a*, 72*a*) and a dielectric material layer (71*b*, 72*b*) disposed on a side of the non-overlapped portion (6) of the air layer (71*a*, 72*a*), in which the dielectric material layer (71*b*, 72*b*) has a same thickness as that of the dielectric plate (3) and comprises the same material as that of the dielectric plate (3).

[6] An antenna device (41) comprises the phase shifter (1) according to any one of [1] to [5].

Although the embodiment of the present invention has been described above, the embodiment described above should not be construed as limiting the invention in the appended claims. It should also be noted that not all the combinations of the features described in the above embodiment are essential to the means for solving the problems of the invention.

The present invention may be enforced with appropriate modification without going beyond the gist of the invention. For example, in the above embodiments, the case of using a triplate line as the transmission line is explained, however, the transmission method in the transmission line is not limited thereto, e.g. strip line and microstrip line may be used.

What is claimed is:

1. A phase shifter comprising:

a signal conductor constituting a transmission line for a signal transmitted through an antenna element;

a dielectric plate comprising a dielectric material facing the signal conductor;

a mobile mechanism for moving the dielectric plate; and a transformer unit disposed on a substrate, wherein a facing area between the signal conductor and the dielectric plate is changed by a movement of the dielectric plate, to change a phase of the signal transmitted through the signal conductor, wherein the transformer unit is provided for impedance matching between an overlapped portion in which the signal conductor faces the dielectric plate and a non-overlapped portion in which the signal conductor does not face the dielectric plate, wherein the signal conductor includes an input-side signal conductor and an output-side signal conductor, the input-side signal conductor extending from the non-overlapped portion to the overlapped portion and passing through the transformer unit, and the output-side signal conductor being connected to an end of the input-side signal conductor on a side of the overlapped portion and extending from the overlapped portion to the non-overlapped portion without any intervention of the transformer unit such that the output-side signal conductor is electrically connected to the end of the input-side signal conductor, wherein the input-side signal conductor is formed in a linear shape and the output-side signal conductor is formed in a linear shape, wherein at the overlapped portion, the output-side signal conductor is disposed at right angles to the input-side signal conductor, wherein the output-side signal conductor comprises a first output-side signal conductor disposed at the overlapped portion and a second output-side signal conductor disposed at the non-overlapped portion integrally as one piece, wherein the transformer unit comprises an air layer and a dielectric material layer disposed on a side of the air layer in the non-overlapped portion, wherein the dielectric material layer has the same thickness as that of the dielectric plate and comprises the same material as that of the dielectric plate.

2. An antenna device comprising:

the phase shifter according to claim 1.

3. The phase shifter according to claim 1, wherein the mobile mechanism moves the dielectric plate along a longitudinal direction of the input-side signal conductor, and the transformer unit is provided at an input-side end of the input-side signal conductor, the transformer unit extending in a moving direction of the dielectric plate.

4. The phase shifter according to claim 3, wherein a conductor cross section of the second output-side signal conductor is greater than a conductor cross section of the first output-side signal conductor.

* * * * *